US006959923B2

(12) United States Patent
Leitz et al.

(10) Patent No.: US 6,959,923 B2
(45) Date of Patent: Nov. 1, 2005

(54) METHOD AND DEVICE FOR IMPROVING STACKER CONVEYOR SPEED IN A MAIL STACKER

(75) Inventors: Jerry Leitz, New Milford, CT (US); Arthur H. DePoi, Brookfield, CT (US); Gary Comstock, New Milford, CT (US)

(73) Assignee: Pitney Bowes Inc., Stamford, CT (US)

( * ) Notice: Subject to any disclaimer, the term of this patent is extended or adjusted under 35 U.S.C. 154(b) by 246 days.

(21) Appl. No.: 10/359,787

(22) Filed: Feb. 10, 2003

(65) Prior Publication Data

US 2004/0155398 A1 Aug. 12, 2004

(51) Int. Cl.[7] ..... B65H 29/14
(52) U.S. Cl. ..... 271/214; 271/215
(58) Field of Search ..... 271/213, 214, 271/215, 2

(56) References Cited

U.S. PATENT DOCUMENTS 4,361,318 A * 11/1982 Stobb ..... 271/202
5,064,185 A * 11/1991 Ricciardi ..... 271/181
5,201,504 A * 4/1993 Fallos et al. ..... 271/2
5,221,080 A * 6/1993 Ricciardi ..... 271/214
5,372,360 A * 12/1994 Ricciardi ..... 271/177

* cited by examiner

*Primary Examiner*—Patrick Mackey
(74) *Attorney, Agent, or Firm*—Michael J. Cummings; Charles R. Malandra, Jr.; Angelo N. Chaclas

(57) ABSTRACT

A method and device for stacking a plurality of vertically oriented mailpieces into a stack, wherein mailpieces are sequentially received into the back end of the stack. A paddle is used to support the front end of the stack in order to prevent the top mailpieces from falling forward. A conveyor belt is used to move the mailpieces in the stack and relieve the pack pressure so as to allow new mailpieces to join the stack. Information indicative of the mailpiece thickness is provided to a movement control module so that the conveyor belt is moved according to the thickness of the mailpieces received into the stack. As such, the pressure in the stack can be properly adjusted. The thickness information can be obtained from an upstream collator, for example.

14 Claims, 5 Drawing Sheets

METHOD AND DEVICE FOR IMPROVING STACKER CONVEYOR SPEED IN A MAIL STACKER

TECHNICAL FIELD

The present invention relates generally to a mail stacking machine and, more particularly, to a vertical, or on-edge, stacker using a roller to move an input mailpiece into the back end of a mail stack.

BACKGROUND OF THE INVENTION

A mass mailing system generally comprises a mail inserting machine and a mail stacking machine. The mail inserting machine includes an envelope feeder and an enclosure document supply section. The envelope feeder is used to feed envelopes, one at a time, to an envelope insertion station. In the enclosure document supply section, a plurality of enclosure feeders is used to release enclosure documents to a chassis. The released documents are then gathered, collated and pushed by a plurality of pusher fingers to the envelope insertion station for insertion. Mail inserting machines are known in the art. For example, Roetter et al. (U.S. Pat. No. 4,169,341) discloses a mail inserting machine wherein documents are released onto a continuous conveyor mechanism to be collected and collated in a continuous process. If necessary, the collation can be folded such that each document is folded into two or more panels. Folding machines are known in the art. For example, Beck et al. (U.S. Pat. No. 4,701,233) discloses a method of folding a sheet by bulging a portion of the sheet and then folding the bulged portion through a roller nip. Marzullo (U.S. Pat. No. 4,875,965) discloses a folding apparatus wherein a buckle chute is used for stopping a sheet, causing the sheet to enter a roller nip for folding. After the enclosure documents are inserted into the envelopes, the filled envelopes are typically transported to another piece of equipment that seals the envelopes and affixes postage or prints a postage indicium on each envelope.

The filled envelopes are typically collected and loaded by an operator into mail trays or other forms of storage. This step in the mass mailing process has been found to be a "bottleneck". One way to assist the operator in eliminating the bottleneck is to use an envelope stacking machine to automatically collect the filled envelopes into a stack so that the operator can remove the filled envelopes in stacks. One of the commonly used envelope stackers is an on-edge stacking apparatus. For example, Keane et al. (U.S. Pat. No. 6,388,204) discloses a mail stacking machine where a belt turn-up unit is used to turn the filled envelope from a horizontally facing direction to a vertical or "on-edge" position. The vertically oriented envelope is driven by a segmented roller into the back end of a vertical stack.

A typical mass mailing system is shown in FIG. 1. The mass mailing system 1 comprises a document collating station 10, a folding device 20, a mail inserting station 30, a mail input device 40 and a mail stacker 100. As shown in FIG. 2, a plurality of documents 12, which are released by a plurality of document feeders in the collation station 10, are collated into a stack or collation 14 as the documents are moved toward the mail inserting station 30. If necessary, the stack 14 is folded into a folded stack 22 prior to the documents being inserted into an envelope 32. After the stuffed envelope is scaled, it is referred to as a mailpiece 50. The mailpiece 50 is turned from a horizontally facing position to a vertical position by the mail input device 40.

The vertically oriented mailpiece 50 is driven into the back end 64 of a vertical mail stack 60 in the mail stacker 100. The mailing system 1 also has a central control module 70, which is operatively connected to all of the sub-systems 10, 20, 30, 40 and 100 in order to coordinate the operation in the sub-systems. For example, if one of the sub-systems is non-functional, it may be necessary to stop all other sub-systems to avoid a jam. Furthermore, the central control module 70 is also used to control the document feeders in the collation station 10 so that only a predetermined number of documents are released to form a stack for mail insertion.

A typical stacking machine 100, as shown in FIG. 3, has an incoming mailpiece moving device 110 to move a mailpiece 50 released from the mailpiece input device 40 into a stacking deck 120 along a moving direction 250. The mailpiece 50 is further driven into the back end 64 of the mail stack 60. The stacking deck 120 has an upstream end 202 and a downstream end 204. As more mailpieces 50 are added to the back end of the mail stack 60, the stack 60 expands or grows toward the downstream end 204 of the stacking deck 120. As the stack expands, the pressure on the incoming mailpiece increases. In order to relieve the stack pressure, a conveyor belt 130 moving along a direction 230 is used to space out the stacked mailpieces, thereby making room for the next incoming mailpiece 50 to join the stack 60. At the same time, a paddle 140 is used to support the front end 62 of the stack, preventing the top mailpieces in the stack from falling toward the downstream end. The paddle 140 is movably disposed on a linear rod 144 for movement. The linear rod, which is substantially parallel to the moving direction 230, is fixedly mounted on rod mounts 146.

In order to achieve optimal operational efficiency, the rate at which the mailpiece input device feeding the mailpieces into the mail stacker is substantially equal to the rate at which the document stack is inserted into the envelope 32 in the mail inserting station. Furthermore, the insertion rate should also be equal to the rate at which the documents are released by each document feeder.

At the same time, the conveyor belt 130 is adapted to move at a certain speed in order to relieve the pressure in the mail stack. If the conveyor belt moves too slowly, the mailpieces will be packed too tightly. After a short time, a new mailpiece will not be able to squeeze into the stack and it will jam. If the conveyor belt moves too fast, the pack pressure will be too light and the mailpieces will move around as they settle down. In that situation, if an incoming mailpiece hits one of the mailpieces in the stack that is out of position, a jam may occur. Moreover, if the pack pressure is too light, the operator has to clear the stack more frequently. This makes the stacker less effective.

It is possible to set the speed of the conveyor belt 130 according to the feeding rate of the mailpiece input device 40. For example, the speed of the conveyor belt can be set in proportion to the feeding rate. Alternatively, the speed of the conveyor belt 130 can be manually adjusted by an operator so as to adjust the pack pressure. However, the pack pressure is not only affected by the feeding rate but by other factors as well. For example, when the mail stacker is first turned on, the motor that drives the conveyor belt is cold. The motor runs faster than when it has warmed up. This requires the operator to adjust the speed at the start up time and again after a few minutes as the machine starts to warm up. Manual adjustment, however, is not always consistent. It relies heavily on the experience of the operator.

One of the major pressure-related problems is caused by the variation of the thickness of the mailpieces. The stack pressure increases as the thickness of the mailpieces increases. If the speed of the conveyor belt is set for thin mailpieces, then this speed will not work well for thick mailpieces, because the stack pressure will rapidly increase, thus quickly causing a full jam. Even if a full jam does not occur, the late arriving mailpieces may not be stacked properly. As such, the edge of the mail stack will not form a straight line, causing a problem for the operator when the mail stack has one or more zip-code breaks. In a typical mail stacker, when the control system is designed to indicate to an operator a zip-code break, a mail stop is moved in front of a registration wall so that the incoming mailpieces stop at the mail stop instead of the registration wall. The thickness of the mail stop is usually about ¾", and the edge of the newly-arriving mailpieces is supposed to shift about the same amount. The shift at the edge serves as an indication to the operator that this is an important point in the stack. When the stack pressure is too high, however, the mailpieces may not be properly stacked to indicate the zip-code break.

It is advantageous and desirable to provide a method and system to control the movement of the conveyor belt so that the pressure in a mail stack can be properly maintained.

SUMMARY OF THE INVENTION

It is a primary objective of the present invention to control the movement of the conveyor belt in a mail stacker so as to maintain a proper pressure in the mail stack. This objective can be achieved by adjusting movement or displacement of the conveyor belt according to the thickness of the mailpieces based on the thickness information provided by the central control module of a mass mailing system.

Thus, according to the first aspect of the present invention, a method of adjusting mail stack pressure in a mail stacking device, wherein the mail stacking device is adapted to stack a plurality of mailpieces into a stack, each mailpiece having a thickness. The stacking device comprises:

a stacking deck having an upstream end and a downstream end;

a moving mechanism disposed on the stacking deck for supporting the stack, the stack having a first end and a second end;

a supporting means positioned relative to the moving mechanism for supporting the second end of the stack;

a mailpiece receiving mechanism, disposed at the upstream end of the stacking deck, for sequentially receiving mailpieces into the first end of the mail stack, wherein for each received mailpiece, the moving mechanism is adapted to move in a moving direction from the upstream end toward the downstream end so as to adjust the pressure in the stack due to receipt of said mailpiece in the stack, said method comprising the steps of:

obtaining information indicative of the thickness of the received mailpiece in the stack, and adjusting the movement of the moving mechanism in the moving direction based on the thickness of the received mailpiece.

Preferably, when each mailpiece includes one or more sheets of enclosure materials, the information is partially based on the number of sheets of the enclosure materials.

Preferably, when the enclosure materials are folded, the information is partially based on the number of panels each sheet of the enclosure materials is folded into, the information is partially based on the total number of panels.

Preferably, when each mailpiece includes enclosure in an envelope, the information is partially based on the thickness of the envelope.

Preferably, the movement of the moving mechanism is effected by a plurality of displacement steps, and the displacement is adjusted based on the thickness of the received mailpiece.

Alternatively, the moving mechanism has a moving speed to effect the movement, and the moving speed is adjusted based on the thickness of the received mailpiece.

Advantageously, the stacker further comprises a sensing means for sensing the pressure in the stack, and the movement of the moving mechanism is also adjusted according to the sensed pressure.

According to the second aspect of the present invention, a mail stacking device for stacking a plurality of mailpieces into a stack, each mailpiece having a thickness. The stacking device comprises:

a stacking deck having an upstream end and a downstream end;

a moving mechanism disposed on the stacking deck for supporting the stack, the stack having a first end and a second end;

a supporting means positioned relative to the moving mechanism so as to support the second end of the stack;

a mailpiece receiving mechanism, disposed at the upstream end of the stacking deck, for sequentially receiving mailpieces into the first end of the mail stack, and a control mechanism, operatively connected to the moving mechanism, for controlling the moving mechanism, wherein for each received mailpiece the moving mechanism is adapted to move in a moving direction from the upstream end toward the downstream end so as to adjust pressure in the stack due to receipt of said mailpiece in the stack, and the control mechanism is adapted to receiving information indicative of the thickness of the received mailpiece so as to adjust the movement of the moving mechanism in the moving direction based on the thickness of the received mailpiece.

Preferably, the movement of the moving mechanism is effected by a plurality of displacement steps, and the displacement is adjusted based on the thickness of the received mailpiece.

Preferably, the stacking device further comprises a driving mechanism for causing the displacement of the moving mechanism, and the control mechanism comprises an encoder operatively connected to the driving mechanism for adjusting the displacement.

Alternatively, the moving mechanism has a moving speed to effect the movement, and the moving speed is adjusted based on the thickness of the received mailpiece.

According to the third aspect of the present invention, a mailing system comprising:

a mail inserter for inserting enclosure materials into envelopes for providing mailpieces, and a mail stacking device, operatively connected to the mail inserter for sequentially receiving the mailpieces for stacking the received mailpieces into a stack, each mailpiece having a thickness. The stacking device comprises:

a stacking deck having an upstream end and a downstream end;

a moving mechanism disposed on the stacking deck for supporting the stack, the stack having a first end and a second end;

a supporting means positioned relative to the moving mechanism so as to support the second end of the stack;

a mailpiece receiving mechanism, disposed at the upstream end of the stacking deck, for inserting the sequentially received mailpieces into the first end of the mail stack, and a control mechanism, operatively connected to the moving mechanism, for controlling the moving mechanism, wherein for each received mailpiece the moving mechanism is adapted to move in a direction from the upstream end toward the downstream end so as to adjust pressure in the stack due to receipt of said mailpiece in the stack, and the control mechanism is adapted to receiving information indicative of the thickness of the received mailpiece so as to adjust the movement of the moving mechanism in the moving direction according to the thickness of the received mailpiece.

The present invention will become apparent upon reading the description taken in conjunction with FIGS. 4 to 5.

BEST MODE TO CARRY OUT THE INVENTION

Figure 1:
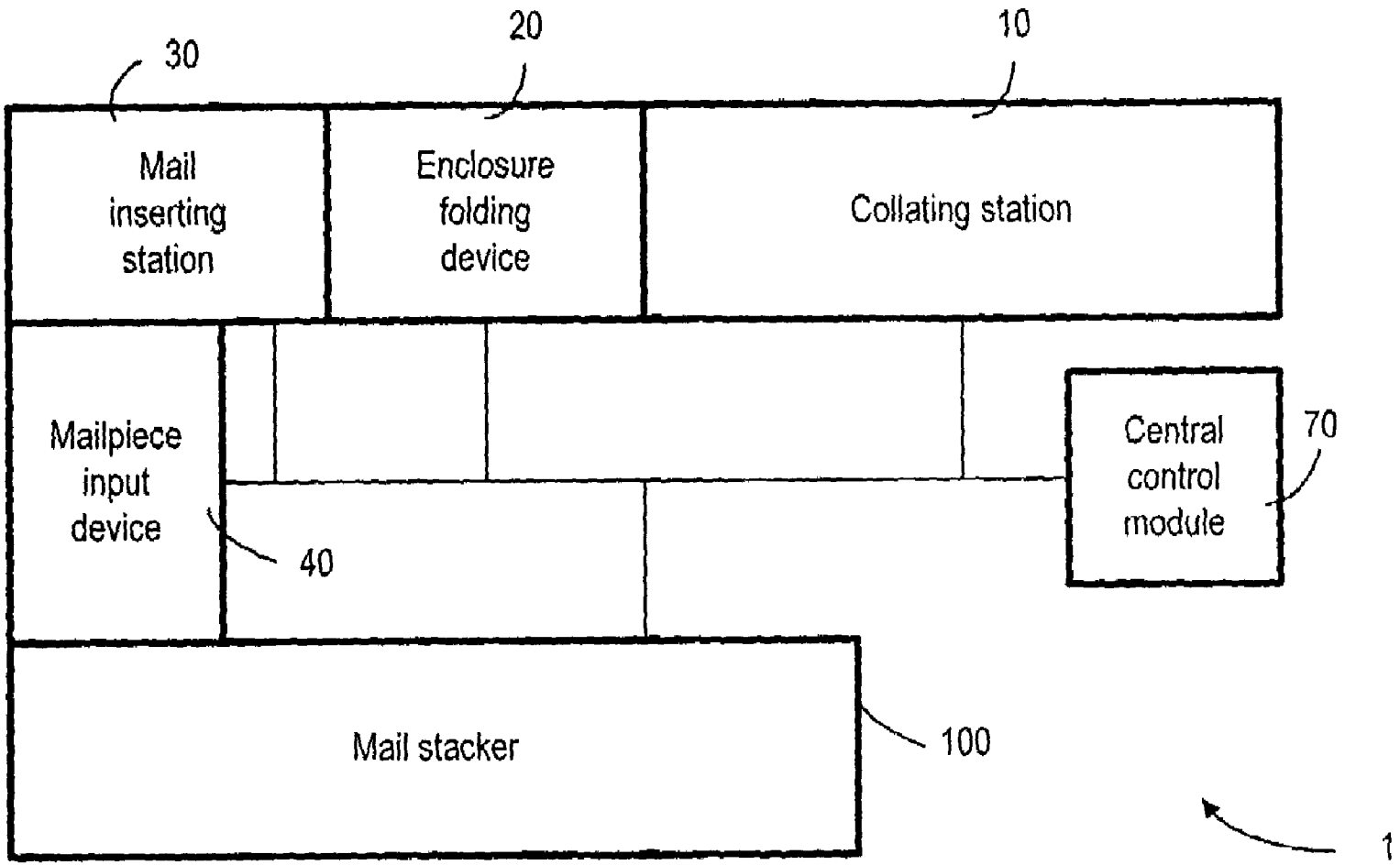
FIG. 1—A Typical mailing system for use with the present invention
Figure 2:
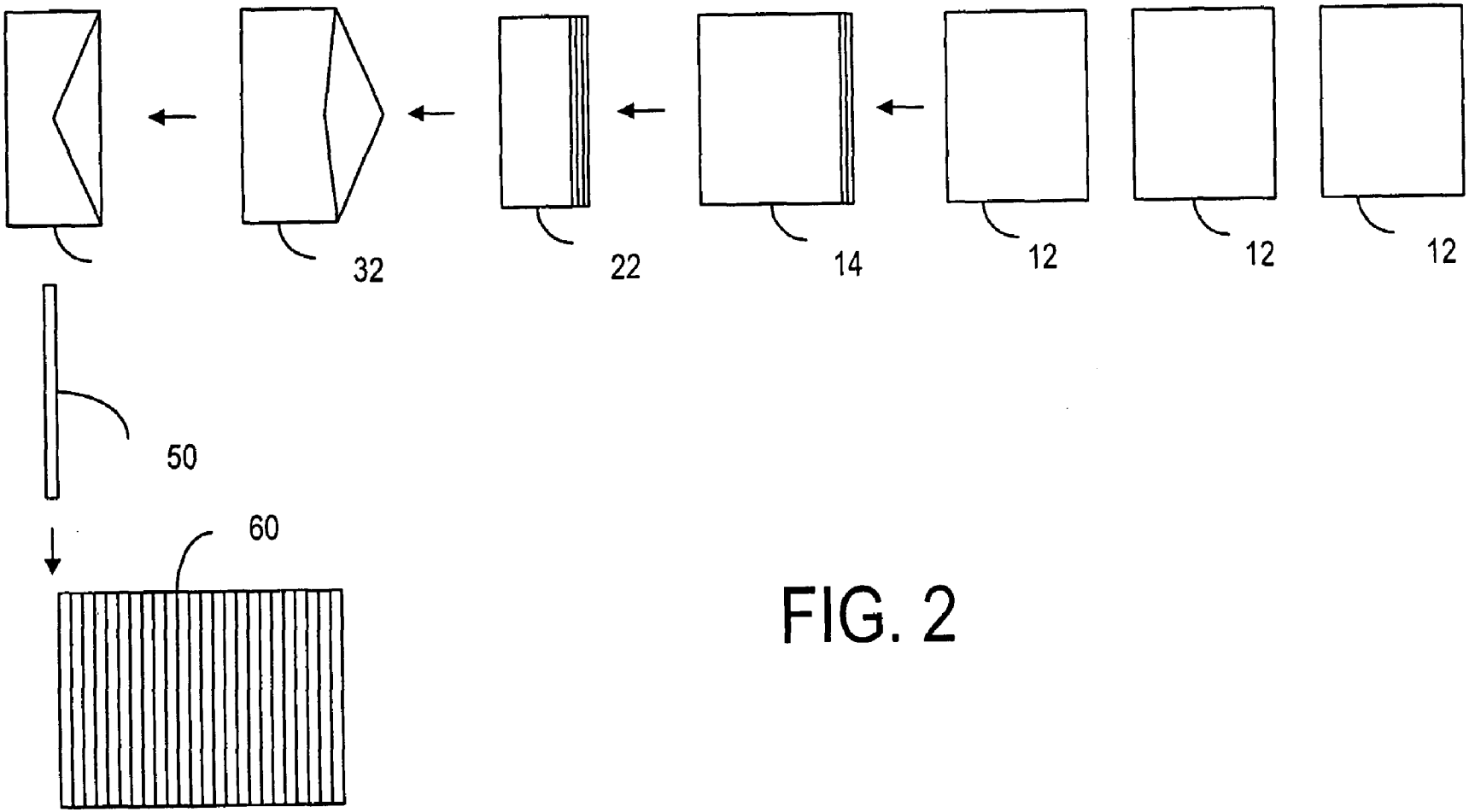
FIG. 2—A document flow for use with present invention
Figure 3:
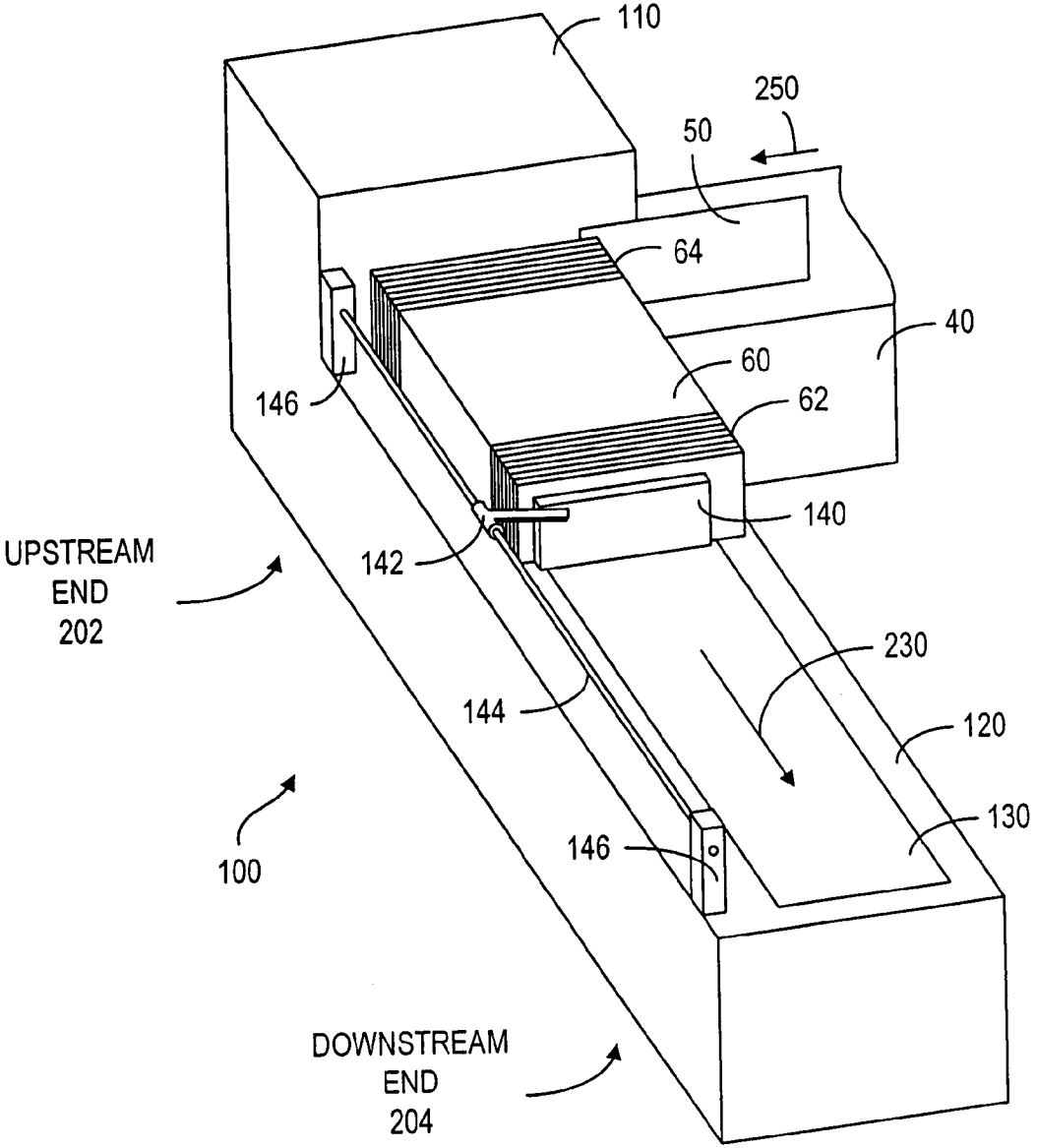
FIG. 3—A stacking machine for use with the present invention

The method of adjusting the pack pressure in the mail stacker, according to present invention, is substantially based on the thickness of the incoming mailpieces 50 that are received into the stack 60. When the thickness is known, the displacement of the conveyor belt 130 along the moving direction 230 can be adjusted accordingly. It should be noted that the movement of the conveyor belts 130 along the moving direction 230 can be intermittent or continuous. Preferably, the movement is intermittent in that it is effected by a plurality of discrete steps, and each of the steps has a displacement distance. When the thickness is known, the displacement distance can be adjusted accordingly. Preferably, the information indicative of the thickness of the mailpiece 50 is obtained from the central control module 70, which monitors and controls the collation as it enters the chassis of the collation station 10 (FIG. 3). The collation is usually made up of a variable number of sheets of enclosure materials. These sheets of enclosure materials may be folded once or twice. For example, the central control module 70 should be able to indicate to the mail stacker 100 that the collation consists of four pages with two folds, for example. Because two folds make three panels, four folded pages are equal to 12 panels. Thus, the enclosure thickness is substantially equal to the thickness of 12 sheets. Knowing the thickness of the paper gives a direct value of the total thickness of the panels. This direct value can be used to adjust the displacement of the conveyor belt 130 along the moving direction 230. Furthermore, the thickness of the envelope 32 (FIG. 2) should also be taken into consideration. For example, the thickness of the envelope can be manually entered into the central control module 70 every time a new batch of envelopes is used for mailing. Alternatively, thickness information of different types of envelopes can be stored in the central control module 70.

Figure 4:
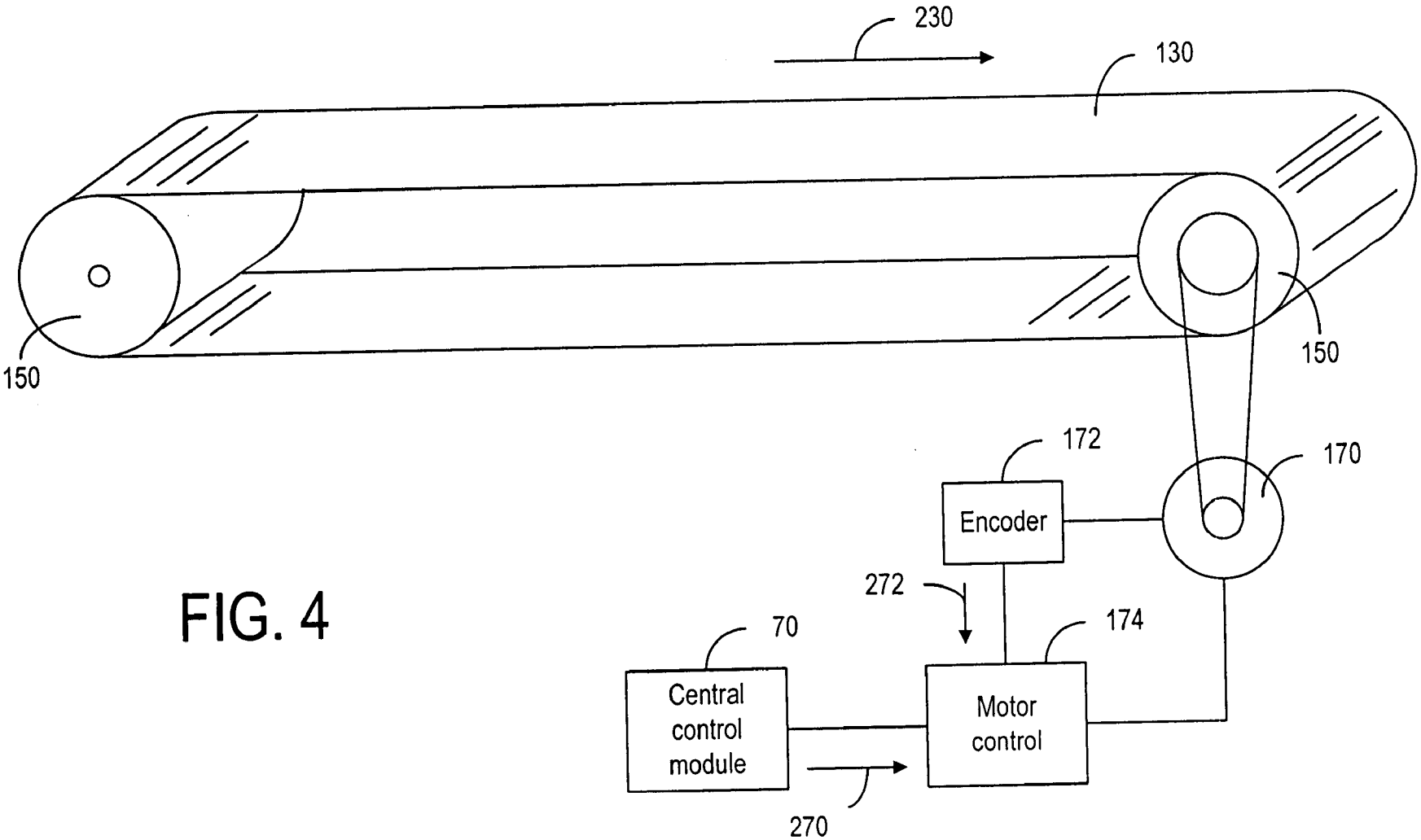
FIG. 4—An exemplary stacking conveyor mechanism in accordance with present invention FIG. 5—Another view of an exemplary stacking conveyor apparatus in accordance with the present invention.

To facilitate the speed or movement adjustment, a motor control module 174, as shown in FIG. 4, is operatively connected to the central control module 70 in order to obtain the thickness information 270 from the control module 70. As shown in FIG. 4, the conveyor belt 130 is looped around two rollers 150 and driven by a motor 170. The control module 70 can control the distance the motor moves, and this distance translates into the distance the conveyor belt moves. The conveyor belt 130 can be moved in small steps, but it can also be moved in a constant speed. Advantageously, an encoder 172 of a certain resolution is operatively connected to the motor 170 to monitor the moving distance of the motor 170 and, thus, the displacement of the conveyor belt 130. The encoder 172 is also operatively connected to the motor control module for providing thereto information 272 indicative of the moving distance of the motor 170. Based on the information 270 and 272, the motor control module determines the distance the conveyor belt needs to move. In particular, the encoder 172 is mounted on the shaft of the motor 170. For example, the encoder 172 comprises a disk having five evenly spaced holes and a stationary photosensor aligned with the holes in order to read the transition in light intensity as the photosensor is blocked and unblocked when the holes pass by the photosensor. Five holes produce ten transitions, or counts, for position detection. Furthermore, a motor 170 is engaged with a gearbox having a gear ratio of 180 to 1. This is equal to 1800 counts per revolution of the gearbox. Furthermore, the pulley linking the roller 150 to the output of the gearbox is designed such that the conveyor belt 130 is displaced by 166.5 mm per revolution of the gearbox. Accordingly, the encoder 172 can measure the displacement of the conveyor belt 130 to a precision of 92.5 microns. With such precision, the motor control 174 is more than adequate to adjust the movement of the conveyor belt 130 according to the thickness of the incoming mailpiece 50. With the encoder 172 in place, the motor control module 174 obtains the resolution (precision) when it starts and uses the resolution whenever the conveyor belt 130 needs to move a certain distance. In a distance-based approach, the motor 170 is turned on when a new mailpiece 50 arrives and turned off when the conveyor belt 130 has moved a desired distance. As such, whether the motor 170 is cold or warmed-up does not affect the pressure in the mail stack 60. In this approach, the conveyor belt 130 makes a large number of small steps as it moves in the moving direction 230. However, the speed of the conveyor belt 130 in this intermittent movement should be high enough to move an incoming mailpiece of any anticipated thickness and to provide ample time to accommodate the next mailpiece.

In a time-based approach, the speed of the conveyor belt 130 is increased to a level high enough to move mail of any thickness. But when the displacement of the conveyor belt 130 has reached a desired distance, the speed of the motor 170 is adjusted according to the thickness of the incoming mailpiece 50. As such, the conveyor belt 130 appears to move in a continuous fashion as the mailpieces continue to enter into the stack 60.

Figure 5:
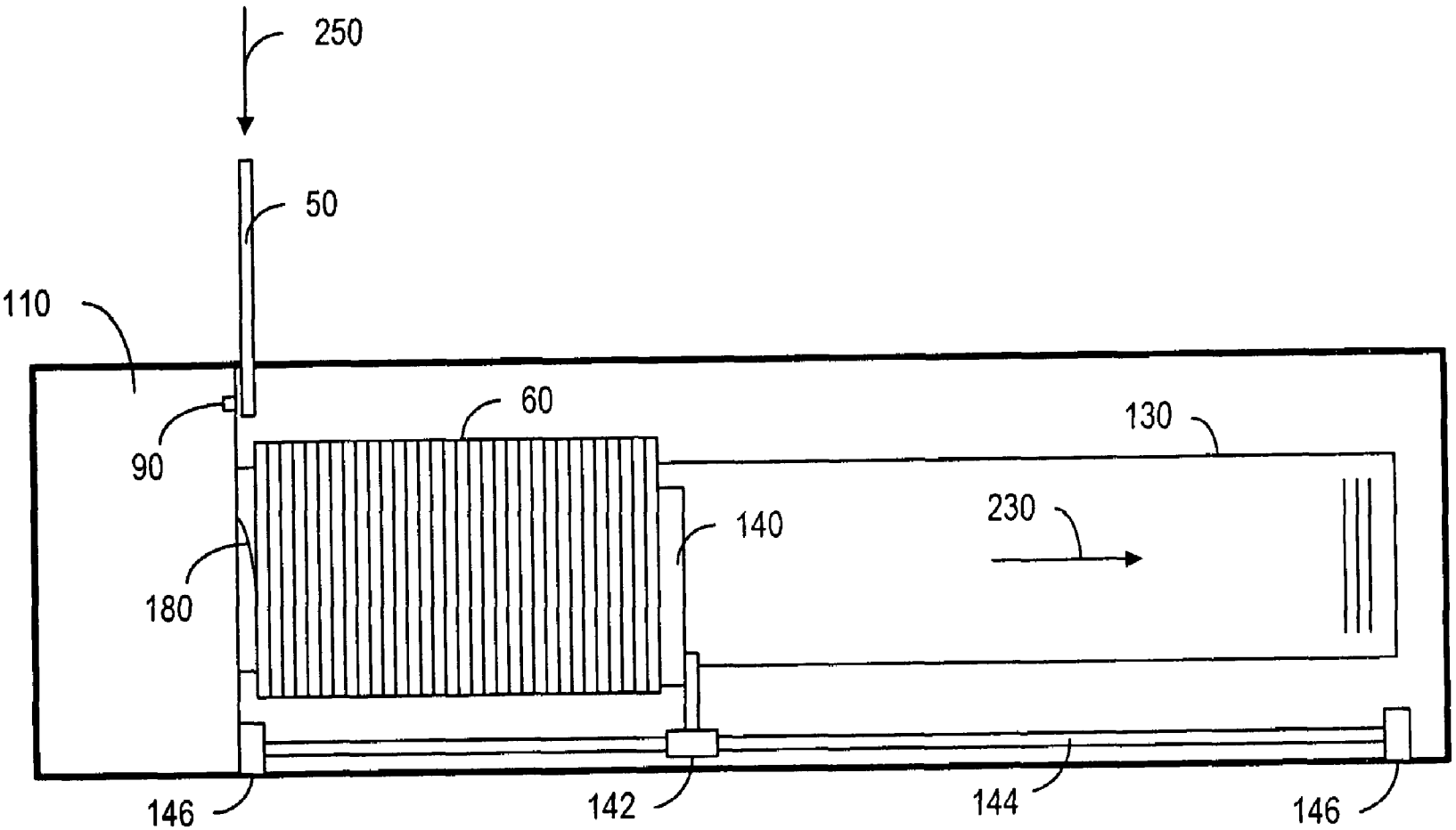

Advantageously, a sensor is provided in the mail stacker to monitor the pack pressure, as shown in FIG. 5. As shown in FIG. 5, the pack pressure sensor 180 is disposed behind the back end 64 of the stack 60. The pack sensor is also operatively connected to the motor control module 174. When a new mailpiece 50 is received into the stacking deck 120, the pack pressure is examined by the pack sensor 180. If the sensor indicates high pack pressure, then the motor control module 174 causes the conveyor belt 130 to move by a distance substantially equal to the thickness of the received mailpiece. If the pack sensor is still indicating a high pressure on the next mailpiece arrival, then the moving distance of the conveyor belt should be increased. Preferably, the increased amount is also based on the thickness of the received mailpiece. The moving distance is progressively increased until the pack sensor does not indicate a high pack pressure. The pack sensor 180 comprises a mechanical switch that can be activated by a spring lever when the lever is pressed by the back end of the stack 60, for example.

It should be noted that the moving speed adjustment method, according to the present invention, can be made independently of the rate at which the mailpieces are received into the stack. Every time a mail piece is received, the conveyor belt can be caused to move a distance substantially equal to the thickness of the received mailpiece. Preferably, the motor control can be informed by the central control module when a new mailpiece arrives at the mail stacker, so that the conveyor belt is moved accordingly. Alternatively, a sensing device 190 can be used to monitor the arrival of a new mailpiece. However, it is also possible to adjust the moving speed of the conveyor belt according to the rate at which the mailpieces are received into the stack as well as the thickness of the mailpiece.

Although the invention has been described with respect to a preferred embodiment thereof, it will be understood by those skilled in the art that the foregoing and various other changes, omissions and deviations in the form and detail thereof may be made without departing from the scope of this invention.

What is claimed is:

1. A method of adjusting mail stack pressure in a mail stacking device, wherein the mail stacking device is adapted to stack a plurality of mailpieces into a stack, each mailpiece having a thickness, said stacking device comprising:

a stacking deck having an upstream end and a downstream end;

a moving mechanism disposed on the stacking deck for supporting the stack, the stack having a first end and a second end;

a supporting means positioned relative to the moving mechanism for supporting the second end of the stack;

a mailpiece receiving mechanism, disposed at the upstream end of the stacking deck, for sequentially receiving mailpieces into the first end of the mail stack, wherein for each received mailpiece, the moving mechanism is adapted to move in a moving direction from the upstream end toward the downstream end so as to adjust the pressure in the stack due to receipt of said mailpiece in the stack, said method comprising the steps of:

monitoring creation of the mailpieces to determine the number of enclosure materials included in each envelope and the number of folds made to the enclosure materials;

receiving information about the thickness of sheets of the enclosure materials;

receiving information about the thickness of the envelopes;

calculating the thickness of each mailpiece based on the number of enclosures, the number of folds, the thickness of the sheets, and the thickness of the envelope;

obtaining the calculated thickness of the received mailpiece in the stack, and adjusting the movement of the moving mechanism based on the calculated thickness of the received mailpiece.

2. The method of claim 1, wherein the stacker further comprises a sensing means for sensing the pressure in the stack, and the movement of the moving mechanism is also adjusted according to the sensed pressure.

3. The method of claim 1, wherein the movement of the moving mechanism is effected by a plurality of displacement steps and wherein the displacement is adjusted based on the thickness of the moving mechanism.

4. The method of claim 3, wherein the stacking device FURther comprises a measuring device capable of measuring the displacement for adjusting the displacement.

5. The method of claim 1, wherein the moving mechanism comprises a conveyor belt disposed on the stacking deck for supporting the stack, and a motor to effect the movement of the conveyor belt.

6. The method of claim 5, wherein the movement of the conveyor belt is effected by a plurality of displacement steps and the stacking device further comprises an encoder positioned relative to the motor to monitor the displacement of the conveyor belt so as to adjust the movement of the conveyor belt.

7. The method of claim 5, wherein the movement of the conveyor belt is continuous and the stacking device further comprises an encoder positioned relative to the motor to monitor the movement of the conveyor belt so as to adjust the movement of the conveyor belt.

8. A mail stacking device for stacking a plurality of mailpieces into a stack, each mailpiece having a thickness, said stacking device comprising:

a stacking deck having an upstream end and a downstream end;

a moving mechanism disposed on the stacking deck for supporting the stack, the stack having a first end and a second end;

a supporting means positioned relative to the moving mechanism so as to support the second end of the stack;

a mailpiece receiving mechanism, disposed at the upstream end of the stacking deck, for sequentially receiving mailpieces into the first end of the mail stack, wherein the mailpiece receiving mechanism is operatively connected to a mail inserting system for receiving the mailpieces therefrom; and a control mechanism, operatively connected to the moving mechanism, for controlling the moving mechanism, wherein for each received mailpiece the moving mechanism is adapted to move in a direction from the upstream end toward the downstream end so as to adjust pressure in the stack due to receipt of said mailpiece in the stack, and the control mechanism is further adapted to monitor creation of the mailpieces to determine the number of enclosure materials included in each envelope and the number of folds made to the enclosure materials;

receive information about the thickness of sheets of the enclosure materials;

receive information about the thickness of the envelopes;

calculate the thickness of each mailpiece based on the number of enclosures, the number of folds, the thickness of the sheets, and the thickness of the envelope; and receive information indicative of the calculated thickness of the received mailpiece so as to adjust the movement of the moving mechanism in the moving direction according to the calculated thickness of the received mailpiece.

9. The mail stacking device of claim 8, wherein the moving mechanism comprises a conveyor belt disposed on the stacking deck for supporting the stack, and a motor operatively connected to the conveyor belt, the motor adapted to rotate in order to effect the movement of the conveyor belt.

10. The mail stacking device of claim 9, wherein the control mechanism comprises an encoder positioned relative to the motor for monitoring the rotation of the motor for adjusting the movement of the conveyor belt.

11. The mail stacking device of claim 10, wherein the motor is adapted to rotate in an intermittent fashion, causing the conveyor belt to displace a distance in the moving direction in order to accommodate each received mailpiece, and the displacement distance of conveyor belt is adjusted based on the thickness of said each received mailpiece.

12. The mail stacking device of claim 10, wherein the motor is adapted to rotate in a continuous fashion, causing the conveyor belt to move in a moving speed, and the moving speed is adjusted according to the thickness of said each received mailpiece.

13. The mail stacking device of claim 8, further comprising a pack sensor positioned relative to the first end of the stack for sensing the pressure in the stack so that the movement of the moving mechanism is also adjusted partly based on the sensed pressure.

14. A mailing system comprising:

a mail inserter for inserting enclosure materials into envelopes for providing mailpieces, and a mail stacking device, operatively connected to the mall inserter, for sequentially receiving the mailpieces for stacking the received mailpieces into a stack, each mailpiece having a thickness, said stacking device comprising:

a stacking deck having an upstream end and a downstream end;

a moving mechanism disposed on the stacking deck for supporting the stack, the stack having a first end and a second end;

a supporting means positioned relative to the moving mechanism so as to support the second end of the stack;

a mailpiece receiving mechanism, disposed at the upstream end of the stacking deck, for inserting the sequentially received mailpieces into the first end of the mail stack, and a control mechanism, operatively connected to the moving mechanism, for controlling the moving mechanism, wherein for each received mailpiece the moving mechanism is adapted to move in a direction from the upstream end toward the downstream end so as to adjust pressure in the stack due to receipt of said mailpiece in the stack, and the control mechanism is adapted to:

monitor creation of the mailpieces in the mail inserter to determine the number of enclosure materials included in each envelope and the number of folds made to the enclosure materials;

receive information about the thickness of sheets of the enclosure materials;

receive information about the thickness of the envelopes;

calculate the thickness of each mailpiece based on the number of enclosures, the number of folds, the thickness of the sheets, and the thickness of the envelope; and receive information indicative of the calculated thickness of the received mailpiece so as to adjust the movement of the moving mechanism in the moving direction according to the calculated thickness of the received mailpiece.

* * * * *